US005830626A

United States Patent [19]

McGuckin et al.

[11] Patent Number: 5,830,626

[45] Date of Patent: Nov. 3, 1998

[54] PHOTOGRAPHIC DEVELOPING COMPOSITION CONTAINING ANTI-SLUDGING AGENT AND USE THEREOF

[75] Inventors: Hugh G. McGuckin, Rochester; John S. Badger; Ronald J. Nothnagle, both of Webster; Jerry L. Willer, Rochester, all of N.Y.

[73] Assignee: Eastman Kodak Company, Rochester, N.Y.

[21] Appl. No.: 920,149

[22] Filed: Aug. 26, 1997

[51] Int. Cl.[6] ..... G03C 5/305

[52] U.S. Cl. ..... 430/488; 430/264; 430/446

[58] Field of Search ..... 430/264, 446, 430/488

[56] References Cited

U.S. PATENT DOCUMENTS

| | | | |
|---|---|---|---|
| 4,839,259 | 6/1989 | Sasaoka et al. | 430/264 |
| 4,914,003 | 4/1990 | Yagihara et al. | 430/264 |
| 4,975,354 | 12/1990 | Machonkin et al. | 430/264 |
| 4,997,743 | 3/1991 | Sasaoka et al. | 430/264 |
| 5,030,547 | 7/1991 | Katoh et al. | 430/264 |
| 5,264,323 | 11/1993 | Purol et al. | 430/264 |
| 5,298,362 | 3/1994 | Beaumond et al. | 430/264 |
| 5,457,011 | 10/1995 | Lehr et al. | 430/488 |
| 5,725,998 | 3/1998 | Sanpei | 430/488 |

*Primary Examiner*—Hoa Van Le
*Attorney, Agent, or Firm*—J. Lanny Tucker

[57] ABSTRACT

A processing composition includes a combination of two different mercapto-substituted anti-sludging agents. The first compound is a conventional mercapto-substituted compound, and the second compound is a mercapto thiadiazole glycerol propoxylate having the formula I:

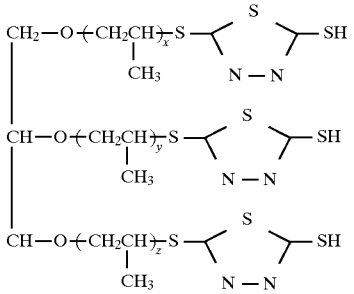

This processing composition can be used to provide black-and-white development of both color reversal and black-and-white photographic elements, and particularly in high contrast graphic arts films.

20 Claims, No Drawings

PHOTOGRAPHIC DEVELOPING COMPOSITION CONTAINING ANTI-SLUDGING AGENT AND USE THEREOF

FIELD OF THE INVENTION

This invention relates to a photographic developing composition that exhibits reduced sludge upon use during processing. It also relates to a method of using this improved composition to process photographic silver halide materials.

BACKGROUND OF THE INVENTION

In the development of photographic elements, such as black-and- white photographic elements, a common problem is the accumulation of "silver sludge" and "dirt" in the developing composition. While the mechanisms whereby such sludge is formed arc varied and complex, an important contributing factor is the presence in developing compositions of compounds such as sulfites which dissolve silver halides and form silver complexes. The silver complexes that are extracted from the photographic element into the developing composition are reduced by other composition components and converted to extremely fine particles of metallic silver that are commonly referred to in the art as "silver sludge".

The formation of silver sludge is a particularly serious problem when the photographic elements are processed in an automatic processing apparatus wherein the sludge particles attach to the walls of the processing tank and/or element transport rollers. The particles can also become attached to the photographic elements. This result can manifest itself as black specks or silver stain on the imaged elements. If sufficiently severe, this can render the photographic element useless for its intended purpose. It is also quite common for the silver to plate out as a well-adhered layer on processor surfaces (such as rollers or tank surfaces).

The problem can be alleviated to some extent by frequent cleaning of processing equipment and processing bath filters to remove accumulated silver sludge, but this adds significantly to operator efforts and cost of the processing operation.

The need to reduce or avoid silver sludge formation or deposition has been a long-standing problem in the photographic art. A wide variety of compounds have been proposed as anti-sludging agents (or sludge inhibitors). They have varying effectiveness. Moreover, many anti-sludging agents exhibit unwanted side effects such as suppressing development or adversely affecting the contrast of the photographic element being processed.

Sulfites are commonly used as preservatives in developing compositions, particularly black-and-white developing compositions, where they serve to extend the life of the composition by protecting against aerial oxidation. While they are major contributors to silver sludge formation and plating, they are not the only source of the problem. Thus, for example, if thiosulfates, thiocyanates or amines are also present, they will also dissolve silver and form silver complexes.

Other factors contributing to sludge formation are replenishment rates, the speed of element transport and the specific design of the processing apparatus. Generally speaking, all of these factors usually guarantee the presence of unwanted sludge when certain black-and-white photographic elements are processed, although the degree of the problem will vary widely depending upon the components of the developing composition, the element composition and the practices of the apparatus operator.

It is known to use hydrazine compounds to promote high contrast development, as described for example in U.S. Pat. No. 4,269,929 (Nothnagle). Moreover, U.S. Pat. No. 4,975,354 (Machonkin et al) describes hydrazine-containing photographic elements useful in the graphic arts. Such elements are typically processed using black-and-white developing composition and silver sludge is commonly formed during such processing.

Copending and commonly assigned U.S. Ser. No. 08/650,675 (filed May 20, 1996, by Nothnagle et al) describes unique anti-sludging agents that are mercapto thiadiazole glycerol propoxylates. Such compounds are effective for this purpose, but must be used at undesirably high concentrations which unreasonably increases processing costs.

There remains a need to find inexpensive, but effective anti-sludging agents or combinations thereof, that will reduce or inhibit sludge formation or deposition when various types of photographic elements, and especially nucleated high contrast elements, are processed.

SUMMARY OF THE INVENTION

The problems described above have been solved with a photographic anti-silver sludging composition comprising:

at least 0.005 g/l of a first anti-sludging agent that is a mercapto-substituted compound, and at least 0.005 g/l of a second anti-sludging agent that is different than the first anti-sludging agent and is a mercapto thiadiazole glycerol propoxylate having the formula I:

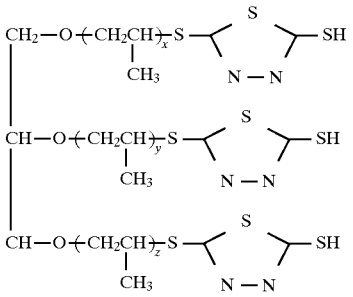

wherein x+y+z is 2.8 to 3.2, and the weight ratio of the first anti-sludging agent to the second anti-sludging agent is from about 1:1 to about 1:10.

This invention also provides a black-and-white photographic processing composition comprising:

a black-and-white developing agent, and the first and second anti-sludging agents described above in the noted amounts.

Further, the present invention provides a method of processing comprising:

contacting an imagewise exposed photographic element with a black-and-white photographic processing composition comprising a black-and-white developing agent, and the first and second anti-sludging agents described above in the noted amounts.

In preferred embodiments, these processed elements are high contrast graphic arts films having incorporated nucleating agents, such as incorporated hydrazine nucleating agents, and incorporated amine boosters.

The composition of this invention effectively reduces the formation of silver sludge in the processing compositions and/or deposition of silver on processing equipment because of the presence of two different anti-sludging agents. In addition, the amount of the second anti-sludging agent can be considerably reduced from what was previously considered necessary by the presence of the mercapto-containing first anti-sludging agent, thereby considerably reducing cost while providing the desired improvements. The processing composition of this invention allows the user to reduce maintenance time since less silver sludge is formed, and yet the elements, including nucleated high contrast elements, are effectively developed without a loss in sensitometric properties.

In addition, because of the use of minor amounts of the second anti- sludging agent described herein, the effectiveness of the first anti-sludging agents can be enhanced at lower than normal concentrations, thereby preventing adverse sensitometric effects that might otherwise occur when those anti-sludging agents are used alone in conventional amounts.

DETAILED DESCRIPTION OF THE INVENTION

The processing compositions of this invention include a mixture of one or more first, and one or more second anti-sludging agents, as described herein. These processing compositions can be used in any desired step of photographic processing of color or black-and-white photographic materials. Preferably, as described below, the processing compositions are black-and-white developing compositions.

The "first" anti-sludging agents are mercapto-substituted compounds that can be acyclic, carbocyclic or heterocyclic compounds substituted with at least one mercapto group. Preferably, such compounds have one or more heterocyclic rings containing at least one nitrogen or oxygen heteroatom. More preferably, the heterocyclic rings have at least one nitrogen atom, and one or more mercapto substituents. More preferably, the heterocyclic ring also includes a sulfur atom.

Materials useful as first anti-sludging agents are generally known in the art as black-and-white developer antifoggants, or emulsion or diffusion transfer tone modifiers and are described, for example, in U.S. Pat. No. 5,264,323 (Purol et al) and U.S. Pat. No. 5,457,011 (Lehr et al), both incorporated herein by reference. Groups of such compounds include mercapto azoles having a 5 to 6 membered heterocyclic ring, such as a pyrimidine, triazine, tetrazole, triazole, imidazole, diazole, oxadiazole or thiadiazole ring. One or more mercapto groups are located on such a ring, and the mercapto groups can have any suitable monovalent cation, such as hydrogen, an alkali metal or an organic amine residue. Also included as useful anti-sludging agents are mercapto-substituted alcohols (including diols), and amino acids containing a mercapto group.

Particularly useful first anti-sludging agents include, but are not limited to, 2-mercaptobenzothiazole, 1,2,4-triazole-3-thiol, 2-benzoxazolethiol, 1-phenyl-5-mercaptotetrazole, 3,3'-dithiobishydrocinnamic acid, 1,4,5-trimethyl-1,2,4-triazoliumthiolate, L-cysteine, L-cystine, and 2-benzimidazolethiol. The first three compounds are preferred, and 2-mercaptobenzothiazole is most preferred. Mixtures of such compounds can also be used. Where appropriate, salts of such compounds can be used.

These compounds are readily available from a number of commercial sources including Aldrich Chemical Company.

The amount of the first anti-sludging agent in the compositions of this invention is at least 0.005 g/l, preferably at least 0.015 g/l, and more preferably at least 0.02 g/l. The upper limit of such compounds is generally 0.1 g/l, preferably 0.05 g/l, and more preferably, 0.03 g/l.

The second anti-sludging agents are mercapto thiadiazole glycerol propoxylates represented by the following structure I:

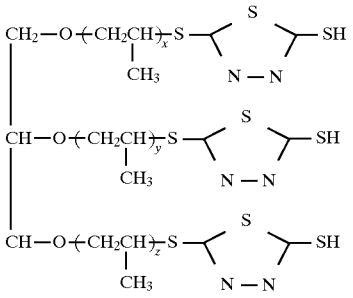

wherein the sum of x+y+z is from 2.8 to 3.2. Such compounds generally have a molecular weight of from about 400 to about 5000, and preferably from about 484 to about 5000. A preferred method for making such compounds is described below. The compound illustrated above is identified hereinbelow as "M743BU".

The second anti-sludging agent is present in the composition in a minimum amount of 0.005 g/l, preferably at least 0.008 g/l, and more preferably at least 0.01 g/l. The maximum amount is 0.2 g/l, preferably 0.1 g/l, and more preferably 0.05 g/l.

Moreover, the weight ratio of the one or more first anti-sludging agents to the one or more second anti-sludging agents is from about 1:1 to about 1:10. Preferably, this ratio is from about 1:1 to about 1:6.

The anti-sludging agents described above can be used as the principal components of a processing solution. Preferably, they are incorporated into a black-and-white developing composition that also includes one or more black-and-white primary developing agents that are commonly used in black-and- white developing compositions. Such materials are well known in the art and include such groups of compounds as dihydroxybenzenes, ascorbic acid compounds, aminophenols and 3-pyrazolidones.

Representative dihydroxybenzenes include, but are not limited to, chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 1,4-dihydroxy-2-acetophenone-2,4-dimethyl-hydroquinone, 2,5-diethylhydroquinone, 2,5-di-p-phenethylhydroquinone, 2,5-dibenzoylaminohydroquinone, 2,5-diacetaminohydroquinone, and others readily apparent to one skilled in the art. Hydroquinone is a preferred compound of this class of developing agents.

Ascorbic acid developing agents have been utilized heretofore in a wide variety of photographic developing processes. Thus, for example, U.S. Pat. No. 2,688,548 (Reynolds) and U.S. Pat. No. 2,688,549 (James et al) disclose developing compositions containing ascorbic acid developing agents and 3-pyrazolidone developing agents. U.S. Pat. No. 3,022,168 (Stjarnkvist) discloses developing compositions containing ascorbic acid developing agents and activating developers such as N-methyl-p-aminophenol. U.S. Pat. No. 3,512,981 (Prchal et al) discloses developing compositions containing a dihydroxybenzene developing agent such as hydroquinone, a sulfite and an ascorbic acid developing agent. U.S. Pat. No. 3,870,479 (Kubotera et al) discloses a lithographic-type diffusion transfer developer containing an ascorbic acid developing agent. U.S. Pat. No. 3,942,985 (Newman et al) describes developing solutions containing an ascorbic acid developing agent and an iron chelate developer. U.S. Pat. No. 4,168,977 (Takada et al), U.S. Pat. No. 4,478,928 (Hess et al) and U.S. Pat. No. 4,650,746 (Simson et al) disclose the use of an ascorbic acid developing agent in processes in which a high contrast photographic element is developed in the presence of a hydrazine compound. U.S. Pat. No. 4,839,259 (Sasaoka et al) and U.S. Pat. No. 4,997,743 (Sasaoka et al) disclose high contrast photographic elements containing a hydrazine compound and an incorporated ascorbic acid developing agent, and U.S. Pat. No. 4,975,354 (Machonkin et al) discloses the use of an ascorbic acid developing agent in developing high contrast photographic elements containing both a hydrazine compound that functions as a nucleating agent and an amino compound that functions as an incorporated booster. All of these noted patents are incorporated herein for their discussion of black-and-white developing agents.

By the term "an ascorbic acid developing agent", as used herein, it is intended to include ascorbic acid and the analogues, isomers and derivatives thereof which function as photographic developing agents. Ascorbic acid developing agents are very well known in the photographic art (see the references cited hereinabove) and include, but are not limited to, the following compounds: L-ascorbic acid, D-ascorbic acid, L-erythroascorbic acid, D-glucoascorbic acid, 6-desoxy-L-ascorbic acid, L-rhamnoascorbic acid, D-glucoheptoascorbic acid, imino-L-erythroascorbic, imino-D-glucoascorbic acid, imino-6-desoxy-L-ascorbic acid, imino-D-glucoheptoascorbic acid, sodium isoascorbate, L-glycoascorbic acid, D-galactoascorbic acid, L-araboascorbic acid, sorboascorbic acid, sodium ascorbate, and other compounds readily apparent to one skilled in the art.

The dihydroxybenzenes and ascorbic acid compounds are preferred as the primary black-and-white developing agents. Of these, hydroquinone and L-ascorbic acid are the most preferred developing agents.

The developing composition of this invention can also include one or more auxiliary super-additive developing agents as are known in the art (Mason, *Photographic Processing Chemistry,* Focal Press, London, 1975), that is to provide a synergistic effect whereby the combined effect of a mixture of two developing agents is greater than the sum of the individual activities. The aminophenols and 3-pyrazolidones are preferred as such components with the last type of compound being more preferred.

For the purposes of this invention, the preferred auxiliary super- additive developing agents are the 3-pyrazolidone developing agents. Particularly preferred developing agents of this class are disclosed in U.S. Pat. No. 5,457,011 (noted above). The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include, but are not limited to, 1-phenyl-5-methyl-3-pyrazolidone, 1-phenyl-4,4-diethyl-3-pyrazolidone, 1-p-aminophenyl-4-methyl-4-propyl-3-pyrazolidone, 1-p-chlorophenyl-4-methyl-4-ethyl-3-pyrazolidone, 1-p-acetamidophenyl-4,4-diethyl-3-pyrazolidone, 1-p-betahydroxyethylphenyl-4,4-dimethyl-3-pyrazolidone, 1-p-hydroxyphenyl-4,4-dimethyl-3-pyrazolidone, 1-p-methoxyphenyl-4,4-diethyl-3-pyrazolidone, 1-p-tolyl-4,4-dimethyl-3-pyrazolidone, and other compounds readily apparent to one skilled in the art.

Useful aminophenols include, but are not limited to, p-aminophenol, o-aminophenol, N-methylaminophenol, 2,4-diaminophenol hydrochloride, N-(4-hydroxyphenyl) glycine, p-benzylaminophenol hydrochloride, 2,4-diamino-6-methylphenol, 2,4-diaminoresorcinol, N-(β-hydroxyethyl)-p-aminophenol, and others readily apparent to one skilled in the art.

More than one primary developing agent can be used in the developing compositions of this invention. For example, the developing composition can contain two different dihydroxybenzene developing agents or two different ascorbic acid developing agents or both a dihydroxybenzene developing agent and an ascorbic acid developing agent. More than one auxiliary super- additive developing agent can be included in the developing compositions of this invention. For example, the developing compositions can contain two different aminophenol developing agents or two different 3-pyrazolidone developing agents or both an aminophenol developing agent and a 3-pyrazolidone developing agent.

The primary developing agent is present in the working strength developing composition in a conventional amount, that is at least 0.05 mol/l, and preferably at least 0.1 mol/l. The upper limit is generally 1 mol/l, and preferably 0.5 mol/l. The auxiliary super-additive developing agent is generally present in the working strength solution of developing composition in an amount of at least 0.001 mol/l, and preferably at least 0.002 mol/l. The upper limit of such compounds is 0.1 mol/l, and preferably 0.01 mol/l.

It is preferred that the processing composition of this invention include one or more sulfite preservatives. By "sulfite preservative" is meant any sulfur compound that is capable of forming sulfite ions in aqueous alkaline solution. Examples of such compounds include alkali metal sulfites, alkali metal bisulfites, alkali metal metabisulfites, sulfurous acid and carbonyl-bisulfite adducts. Examples of preferred sulfites include, but are not limited to, sodium sulfite, potassium sulfite, lithium sulfite, sodium bisulfite, potassium bisulfite, lithium bisulfite, sodium metabisulfite, potassium metabisulfite and lithium metabisulfite. The carbonyl-bisulfite adducts that are useful in as sulfite preservatives are described, for example, in U.S. Pat. No. 5,457,011 (noted above).

The amount of sulfite preservative used in the working strength processing compositions can vary widely, but generally it is present in an amount of at least 0.05 mol/l, and preferably at least 0.1 mol/l. The upper limit is generally 1.0 mol/l, and preferably 0.5 mol/l.

The processing compositions of this invention, when used in working strength, generally have a pH of from about 8 to about 13, and preferably from about 9 to about 11.5. Suitable buffers, such as carbonates, borates and phosphates can be used to provide or maintain the desired pH.

The processing compositions of this invention can also include one or more optional components that are commonly used in black-and-white developing compositions, such as metal ion sequestering agents, biocides (including fungicides), antifoggants, antioxidants, stabilizing agents and contrast- promoting agents. Such materials are known in the art, for example U.S. Pat. No. 5,264,323 (Purol et al), U.S. Pat. No. 5,298,362 (Beaumond et al), and U.S. Pat. No. 5,457,011 (noted above). all of which are incorporated herein by reference with respect to the description of developing compositions. Useful stabilizing agents are (α-ketocarboxylic acids as described for example in U.S. Pat. No. 4,756,997. Useful biocides include, but are not limited to, isothiazolines such as 1,2-benzisothiazolin-3-one, 2-methyl-4-isothiazolin-3-one, 2-octyl-4-isothiazolin-3-one and 5-chloro-N-methyl-4-isothiazolin-3-one.

The developing composition of this invention can be used to process any suitable black-and-white or color reversal photographic silver halide element. To process color reversal films and papers, the black-and-white developing composition is generally used in the first development stop prior to treatment with a reversal bath and a color developing solution. Such photographic elements and processes are well known in the art, as described for example, in U.S. Pat. No. 5,523,195 (Darmon et al).

Preferably, the compositions of this invention are useful to provide black-and-white images in black-and-white films or papers, including radiographic films, aerial films, industrial films and graphic arts films as well as amateur and professional black-and-white films and papers. More preferably, the elements are nucleated, high contrast films used in the graphic arts industry that contain hydrazine nucleating agents. Such materials are well known, as described for example in U.S. Pat. No. 4,975,354 (Machonkin et al), U.S. Pat. No. 5,264,323 (noted above), U.S. Pat. No. 5,298,362 (noted above), all of which are incorporated herein by reference for their description of such photographic materials, and the many references noted therein.

As indicated hereinabove, the formation and deposition of silver sludge are particularly serious problems while processing such films in automatic machine processing equipment. Such devices employ numerous conveyance rollers on which silver sludge can deposit and from which it can transfer to the photographic element being processed. Automatic processing equipment utilizing conveyance rollers are very well known in the art.

Such processed films can also include contrast-promoting agents such as amino compounds as described, for example, in U.S. Pat. No. 4,975,354 (noted above).

Photographic systems depending on the combined action of a hydrazine compound that functions as a nucleating agent and an amino compound that functions as an incorporated booster are exceedingly complex and their successful utilization is critically dependent on being able to adequately control numerous properties including speed, contrast, dot quality, pepper fog, image spread, discrimination and practical density point. Such systems are strongly influenced not only by the composition of the photographic element but by the components of the developing composition and by such factors as development pH, time and temperature. In addition, sludge control is essential and the present invention provides that control.

In processing photographic elements with the developing compositions of this invention, the time and temperature employed for development can be varied widely. Typically, the development temperature will be in the range of from about 20° C. to about 50° C., more preferably in the range of from about 25° C. to about 40° C., while the development time will be in the range of from about 10 seconds to about 150 seconds, more preferably in the range of from about 20 seconds to about 120 seconds.

Following development, the black-and-white photographic element can be further processed in one or more fixing solutions, stabilizing solutions or wash baths using conventional solutions and conditions.

The following examples are intended to illustrate the practice of this invention, and not to limit it in any way.

MATERIALS AND METHODS FOR EXAMPLES

A preferred second anti-sludging agent of Formula I wherein x+y+z is about 3, can be prepared as follows:

1. To a 100 ml 3 neck flask, equipped with an air driven overhead stirrer, thermometer, condenser, addition funnel, and ice/salt water bath, charge 10.0 g (0.040 mol) of DOW Polyol PT 250, 14.01 g (19.2 ml, 0.138 mol) triethylamine, and 25 ml propyl acetate. Cool the resulting clear solution to approximately 0° C.

2. Add 15.40 g (10.2 ml, 0.134 mol) methanesulfonyl chloride in a dropwise manner over 45 minutes at 0° C. The addition is exothermic and off white solids (triethylamine hydrochloride) form (and become thick) as the addition proceeds. When the addition is complete, remove the cooling bath and let the slurry warm to ambient temperature, stir 30 minutes.

3. Filter directly into a 250 ml 3 neck flask, rinse the 100 ml flask and the triethylamine hydrochloride collected on the filter funnel with 25 ml of propyl acetate. The volume of the filtrate is approximately 45 ml here.

4. Equip the 250 ml, 3 neck flask containing the filtrate (from above) with an air driven overhead stirrer, thermometer, reflux condenser, and constant temperature bath, and add thereto 80 ml (62.9 g) of isopropyl alcohol (IPA), and 24.0 g (0.16 mol) of dimercaptothiadiazole (DMTD) to the trimesylate solution in the flask.

5. Add 6.00 g (0.081 mol) of calcium hydroxide to the yellow slurry. This reaction is exothermic of approximately 20° C. (temp. to 38° C.) as the basic calcium hydroxide reacts with the acidic DMTD. Let this exotherm occur without external cooling.

6. Heat the reaction in a 75° C. constant temperature bath (reaction temp 72° C.) for 16 hours (overnight). A thin yellow slurry results.

7. Distill the propyl acetate (PrOAc) and IPA solvent mixture from 81° –83° C. under atmospheric pressure. Apply aspirator vacuum slowly at the end until a thick yellow material (approximately 50 ml volume) remains in the flask (85 ml of solvent collected).

8. Add 70 ml PrOAc to the yellow residue, warm to 50° C., and stir to a uniform slurry. Filter the fine yellow solids, and rinse with 20 ml PrOAc.

9. Wash residual calcium salts out of the PrOAc solution with the following water washes: Wash #1: Add 10 ml of water to the above filtrate, stir and separate layers, and recover 9 ml of the aqueous layer. Wash #2: Add 10 ml water and separate as above, and recover 12 ml of the lower layer. Wash #3: Add 10 ml of water and separate as above, and recover 11.5 of the lower layer.

10. Azeotropically distill under atmospheric pressure (81° –92° C.) until approximately 35 ml has been collected (about 2 ml of water separates in the distillate), or until the temperature has risen from approximately 81° to 92° C. Add 25 ml of PrOAc and continue distilling until the distillation temperature reaches approximately 94° C. and distillation slows almost to a stop (full steam bath heating).

11. Slowly apply aspirator vacuum and remove most of the remaining PrOAc until the volume in the flask is approximately 50 ml.

12. Add 100.0 g (89.4 ml) of di(ethylene glycol). Rinse all of the weighed di(ethylene glycol) into the flask with approximately 20 ml of propyl acetate. Warm to approximately 50 ° C. and filter through glass fiber to remove any traces of remaining solids.

13. Slowly apply aspirator vacuum to the solution and collect the distilling propyl acetate. Warm the orange solution to 80° C. When no more distillate condenses, hold at 75°–80° C. with good stirring for 30 minutes under full aspirator vacuum. This is to remove all of the remaining PrOAc and IPA solvents.

14. Cool the hazy, orange-red solution to approximately 40° C., and release vacuum. Recover a di(ethylene glycol)

solution of mercapto thiadiazole glycerol propoxylate of Formula I wherein x+y+z is approximately 3.

The basic procedure for evaluating the anti-silver sludging properties of various anti-sludging (or combinations) involved placing "seasoned" developing composition (150 ml) containing the compounds in a clean plastic photographic tray, incubating the composition in the dark for about 18 hours at about 36°C., and then observing any sludge formation in the composition and any plated out silver on the tray.

"Seasoned" developing composition was obtained by placing commercially available RA 2000 Developer (Eastman Kodak Company, 300 ml, diluted 1+2) in a stainless steel, water jacketed tray, and while being agitated in ASTM motion, two sheet of commercially available PRECISION LINE LPF4 graphic arts film were developed for 90 seconds each at about 24° C. (75° F.). The resulting "seasoned" developing composition contained about 6–9 mg Ag/l, as measured by conventional spectrophotometry.

| | |
|---|---|
| Hydroquinone developing agent | 25 g/l |
| 4-Hydroxymethyl-4-methyl-1-phenyl-3-pyrazolidone auxiliary developing | 1 g/l |
| Potassium sulfite (45% solution) | 50 g/l |
| Potassium carbonate (47% solution) | 40 g/l |
| Diethylenetriaminepentaacetic acid sequestering agent | 10 g/l |
| pH of 10.35–10.45 at 25° C. | |

"MBT" is 2-mercaptobenzothiazole. "M743BU" is the second anti- sludging agent identified above.

In all of the "seasoned" developing compositions described below containing "M743BU" contained a small amount of a fluffy, white, flocculent precipitate which was determined by chemical analysis to be a mixture of the pure compound and a silver salt thereof. This precipitate was not a detriment in the use of developing compositions of this invention.

Examples 1–5

The following developing compositions containing "seasoned" RA 2000 Developer, with and without one or more anti-sludging agents, were prepared and evaluated as described above:

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control A | None | None | Yes | Yes* |
| Control B | M743BU (148) | None | No | No |
| Example 1 | M743BU (74) | MBT (12.5) | No | No |
| Example 2 | M743BU (37) | MBT (18.75) | No | No |
| Control C | None | MBT (25) | No | No |
| Example 3 | M743BU (22) | MBT (18.75) | No | No |
| Example 4 | M743BU (15) | MBT (18.75) | No | No |
| Example 5 | M743BU (7) | MBT (18.75) | No | No |

*Severe

All of Examples 1–5 exhibited no silver sludging or silver plating. Controls B and C. also demonstrated these results. However, use of the first anti-sludging agent alone as in Control B would be an expensive processing method because of the high unit cost of the single anti-sludging agent. While inhibiting silver sludging and plating, Control C is not a desirable co although effective in this experimental test environment, it controls silver sludging and plating, it fails to do so in more seasoned solutions or in other processing equipment.

Example 6

The procedure described in Examples 1–5 was followed except that the RA2000 Developer solution was diluted 1+4. Control D solution did not contain either anti-sludging agent. The evaluations are described in the following table.

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control D | None | None | No | Yes* |
| Example 6 | M743BU (22.2) | MBT (11.4) | No | No |

*Severe

This example shows that the combination of anti-sludging agents provide desired results in a more diluted developing composition.

Example 7

Example 6 was repeated except that RA2000 Developer was diluted 1+7. Control E contained no anti-sludging agents. The evaluations are shown in the following table.

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control E | None | None | No | Yes* |
| Example 7 | M743BU (13.88) | MBT (7.12) | No | No |

*Severe

This example shows that the combination of anti-sludging agents provide desired results in an even more diluted developing composition.

Examples 8–10

The following developing compositions containing "seasoned" RA 2000 Developer were prepared and evaluated as described above in Examples 1–5:

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control F | None | None | Yes (slight) | Yes* |
| Control G | None | MT (15) | No | Yes (slight) |
| Control H | None | MT (5) | No | Yes (slight) |
| Example 8 | M743BU (37) | MT (25) | No | No |
| Example 9 | M743BU (37) | MT (15) | No | No |
| Example 10 | M743BU (37) | MT (5) | No | No |
| Control I | M743BU (37) | None | No | No |

*Severe
"MT" is 1H-1,2,4-triazole-3-thiol.

All of Examples 8–10 exhibited no silver sludging or silver plating. Control I also demonstrated these results, but use of the first anti-sludging agent alone is an expensive processing method because of the high unit cost of the single anti-sludging agent.

Examples 11–13

The following developing compositions containing "seasoned" RA 2000 Developer were prepared and evaluated as described in Examples 1–5 above:

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control J | None | None | Yes (slight) | Yes* |
| Control K | None | BOT (25) | No | No |
| Control L | None | MT (15) | No | No |
| Control M | None | MT (5) | Yes (slight) | Yes (slight) |
| Example 11 | M743BU (37) | MT (25) | No | No |
| Example 12 | M743BU (37) | MT (15) | No | No |
| Example 13 | M743BU (37) | MT (5) | No | Yes (very slight) |

*Severe
"BOT" is benzoxazolethiol.

All of Examples 11–13 exhibited no silver sludging and no or very little silver plating. Controls K and L also demonstrated these results, however, use of the single anti-sludging agent is undesirable for the same reason stated above for Control C.

Example 14

The procedures described in Examples 1–5 were followed using an ascorbic acid developing composition having the following formulation:

| | |
|---|---|
| Potassium carbonate | 100 g/l |
| Potassium sulfite | 44 g/l |
| KOH (45%) | 5 g/l |
| Ascorbic acid (L-ascorbic) | 35 g/l |
| Dimezone | 2 g/l |
| Sodium bromide | 3.8 g/l |
| KODAK Anti-calcium No. 8 (40%) | 10 g/l |
| IRGAFORM 3000 (50%) | 3.35 g/l |
| Benzotriazole | 0.2 g/l |
| "M743BU" | 37 mg/l |
| "MBT" | 19 mg/l |
| pH of 10.5 | |

Control N was a developing composition like that used in Example 14 except that the two anti-sludging agents were omitted. The observed results are shown in the following table.

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control N | None | None | Yes (slight) | Yes (slight) |
| Example 14 | M743BU (37) | MBT (19) | Yes (slight) | No |

The ascorbic acid developing composition performed acceptably with the combination of anti-sludging agents, with only minimal silver sludging. Without the two anti-sludging agents, the combined effects of silver sludging and plating was unacceptable.

Example 15

The procedures described in Examples 1–5 above were followed using conventional KODAK RPX-OMAT X-ray Developer, with and without the two anti-sludging agents. This commercial developing composition has the following formulation:

Hydroquinone developing agent 22 g/l

1-Phenyl-3-pyrazolidinone auxiliary developing agent 1.3 g/l

Potassium sulfite 65 g/l

Carbonate buffer 10 g/l pH of 10.3

The evaluation results are shown in the following table:

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control O | None | None | No | Yes* |
| Example 15 | M743BU (37) | MBT (19) | No | No |

*Severe

Example 16

The developing composition of Example 2 was used in a conventional KODAMATIC 66S processor for a long term processing test. Approximately 1800 $ft^2$ (167 $m^2$) were processed over 35 days for a total of 8.8 tank turnovers (a tank turnover refers to the equivalent of replacing one tank volume with a combination of carry-in and fresh developing composition replenisher). A variety of commercial graphic arts films, including scanner, contact, duplicating, projection, camera and general purpose films, were processed and evaluated for any adverse sensitometric effects. No adverse sensitometric effects were observed in any of the processed films. No silver sludging was observed.

After almost 9 tank turnovers, there was very little change observed in the appearance in the transport roller racks or on the developing tank walls. Only a very slight amount of white precipitate was observed in the solution. In contrast, when "M743BU" was used alone at 148 mg/l, silver sludging was nonexistent, but the white precipitate in the solution was considerably more.

Example 17

The procedure described in Example 16 was followed using a developing composition like that described in Example 6 except that the concentrations of "M743BU" and "MBT" were 22 and 15 mg/l, respectively. After about 9 tank turnovers, the transport roller racks and developing tank walls were clean, and no silver sludge was observed in the developing tank. There were some slight sensitometric effects observed at the beginning of the processing, but all of the processed films were considered acceptable.

Examples 18–20

Commercially available PRECISION LINE film was imaged and processed using seasoned developing compositions with varying amounts of anti-sludging agents. After 18 hours in dark incubation at 36° C., the compositions were then evaluated for silver sludge formation and silver plating in the developing tanks. The results are shown in the following table:

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| Control P | M743BU (37) | None | Yes | Yes |
| Example 18 | M743BU (37) | MBT (25) | No | No |
| Control Q | M743BU | None | Yes | Yes |

-continued

| COMPOSITION | 1ST ANTI-SLUDGING AGENT (mg/l) | 2ND ANTI-SLUDGING AGENT (mg/l) | Ag SLUDGE? | Ag PLATING? |
|---|---|---|---|---|
| | (18.5) | | | |
| Example 19 | M743BU (18.5) | MBT (25) | No | No |
| Control R | M743BU (9.25) | None | Yes | Yes |
| Example 20 | M743BU (9.25) | MBT (25) | No | No |
| Control S | None | None | Yes | Yes |
| Control T | None | MBT (25) | No | No |

Significant silver sludging and plating were observed when only the M743BU anti-sludging agent was used alone. With no anti-sludging agent (Control S), slightly worse silver sludging and plating were observed. By comparison, with the combination of two anti-sludging agents, no silver sludging or plating was observed at all levels of M743BU.

The invention has been described in detail with particular reference to preferred embodiments thereof, but it will be understood that variations and modifications can be effected within the spirit and scope of the invention.

We claim:

1. A photographic processing composition comprising:

at least 0.005 g/l of a first anti-sludging agent that is a mercapto-substituted compound, and at least 0.005 g/l of a second anti-sludging agent that is different than said first anti-sludging agent and is a mercapto thiadiazole glycerol propoxylate having the formula I:

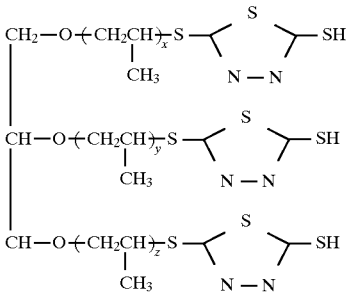

wherein x+y+z is 2.8 to 3.2, and the weight ratio of said first anti-sludging agent to said second anti-sludging agent is from about 1:1 to about 1:10.

2. The composition of claim 1 further comprising a black-and-white developing agent.

3. The composition of claim 2 wherein said black-and-white developing agent is a dihydroxybenzene compound or an ascorbic acid compound.

4. The composition of claim 1 wherein said second anti-sludging agent has a molecular weight of from about 400 to about 5000.

5. The composition of claim 1 wherein said first anti-sludging agent is a mercapto-substituted heterocyclic compound that is present in an amount of from about 0.015 to about 0.1 g/l.

6. The composition of claim 1 wherein said first anti-sludging agent is 2-mercaptobenzothiazole, 1,2,4-triazole-3-thiol, 2-benzoxazolethiol, 1-phenyl-5-mercaptotetrazole or 3,3'-dithiobishydrocinnamic acid.

7. The composition of claim 2 further comprising an auxiliary super-additive developing agent.

8. The composition of claim 7 wherein said auxiliary super-additive developing agent is a 3-pyrazolidone or aminophenol.

9. The composition of claim 1 further comprising a sulfite preservative.

10. The composition of claim 1 wherein said second anti-sludging agent is present in an amount of from about 0.008 to about 0.2 g/l.

11. A black-and-white photographic processing composition comprising:

a dihydroxybenzene or ascorbic acid developing agent, an auxiliary super-additive developing agent, from about 0.015 to about 0.05 g/l of a first anti-sludging agent that is 2-mercaptobenzothiazole, 1,2,4-triazole-3-thiol, 2-benzoxazolethiol, 1-phenyl-5-mercaptotetrazole or 3,3'-dithiobishydrocinnamic acid, and from about 0.008 to about 0.1 g/l of a second anti-sludging agent that is a mercapto thiadiazole glycerol propoxylate having the formula I:

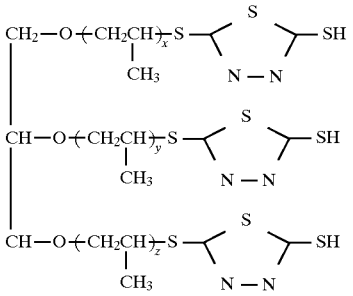

wherein x+y+z is 2.8 to 3.2, and the molar ratio of said first anti-sludging agent to said second anti-sludging agent is from about 1:1 to about 1:6.

12. The composition of claim 11 further comprising a sulfite preservative in an amount of from about 0.05 to about 0.5 mol/l, and said auxiliary super-additive developing agent is a 3-pyrazolidone or aminophenol present in an amount of from about 0.001 to about 0.1 mol/l.

13. A method of processing comprising:

contacting an imagewise exposed photographic element with a black-and-white photographic processing composition comprising:

a black-and-white developing agent, at least 0.005 g/l of a first anti-sludging agent that is a mercapto-substituted compound, and at least 0.005 g/l of a second anti-sludging agent that is different than said first anti-sludging agent and is a mercapto thiadiazole glycerol propoxylate having the formula:

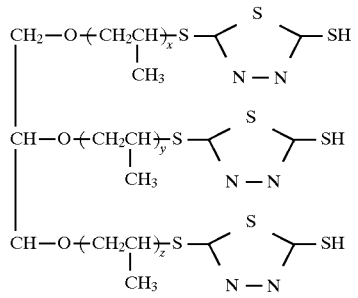

wherein x+y+z is 2.8 to 3.2, and the weight ratio of said first anti-sludging agent to said second anti-sludging agent is from about 1:1 to about 1:10.

14. The method of claim 13 wherein said photographic element is a color reversal photographic film, and said method further comprises color development after contact with said black-and-white developing composition.

15. The method of claim 13 wherein said photographic element is a black-and-white photographic element, and said method further comprises fixing after contact with said black-and-white developing composition.

16. The method of claim 15 wherein said photographic element is a high contrast graphic arts film having incorporated therein a hydrazine nucleating agent, and an amino compound that functions as an incorporated booster.

17. The method of claim 13 wherein said first anti-sludging agent is a mercapto-substituted heterocyclic compound present in an amount of from about 0.015 to about 0.1 g/l.

18. The method of claim 13 wherein said second anti-sludging agent is present in an amount of from about 0.008 to about 0.2 g/l.

19. The method of claim 13 wherein said first anti-sludging agent is 2-mercaptobenzothiazole, 1H-1,2,4-triazole-3-thiol or benzoxazolethiol, and the weight ratio of said first anti-sludging agent to said second anti-sludging agent is from about 1:1 to about 1:6.

20. A method of processing comprising:

developing an imagewise exposed high contrast graphic arts film that contains a hydrazine nucleating agent and an amino compound that functions as an incorporated booster, with a black-and-white developing composition comprising:

a black-and-white developing agent, an auxiliary super-additive developing agent, at least 0.005 g/l of a first anti-sludging agent that is a mercapto-substituted compound, and at least 0.005 g/l of a second anti-sludging agent that is different from said first anti-sludging agent and is a mercapto thiadiazole glycerol propoxylate having the formula I:

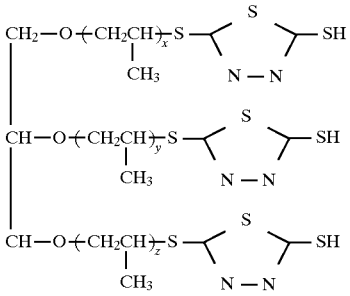

wherein x+y+z is 2.8 to 3.2, and the weight ratio of said first anti-sludging agent to said second anti-sludging agent being from about 1:1 to about 1:10.

* * * * *